US008037565B2

(12) United States Patent
Herkle et al.

(10) Patent No.: US 8,037,565 B2
(45) Date of Patent: Oct. 18, 2011

(54) METHOD FOR DETECTING ABNORMALITY IN A FABRIC TREATMENT APPLIANCE HAVING A STEAM GENERATOR

(75) Inventors: Christoph Herkle, Schwäbisch Gmünd (DE); Thomas Benne, Schorndorf (DE)

(73) Assignee: Whirlpool Corporation, Benton Harbor, MI (US)

( * ) Notice: Subject to any disclaimer, the term of this patent is extended or adjusted under 35 U.S.C. 154(b) by 947 days.

(21) Appl. No.: 11/848,559

(22) Filed: Aug. 31, 2007

(65) Prior Publication Data

US 2009/0056036 A1 Mar. 5, 2009

(51) Int. Cl.
*D06F 39/04* (2006.01)

(52) U.S. Cl. ..... 8/149.3; 68/5 R

(58) Field of Classification Search ..... 8/149.3
See application file for complete search history.

(56) References Cited

U.S. PATENT DOCUMENTS

| | | | |
|---|---|---|---|
| 369,609 | A | 9/1887 | Montanye |
| 382,289 | A | 5/1888 | Ballard |
| 480,037 | A | 8/1892 | Rowe et al. |
| 647,112 | A | 4/1900 | Pearson |
| 956,458 | A | 4/1910 | Walter |
| 1,089,334 | A | 3/1914 | Dickerson |
| 1,616,372 | A | 2/1927 | Janson |
| 1,676,763 | A | 7/1928 | Anetsberger et al. |
| 1,852,179 | A | 4/1932 | McDonald |
| 2,314,332 | A | 3/1943 | Ferris |
| 2,434,476 | A | 1/1948 | Wales |
| 2,778,212 | A | 1/1957 | Dayton et al. |
| 2,800,010 | A | 7/1957 | Dunn |
| 2,845,786 | A | 8/1958 | Chrisman |
| 2,881,609 | A | 4/1959 | Brucken |
| 2,937,516 | A | 5/1960 | Czaika |
| 2,966,052 | A | 12/1960 | Syles |
| 3,035,145 | A | 5/1962 | Rudolph |
| 3,060,713 | A | 10/1962 | Burkall |
| 3,223,108 | A | 12/1965 | Martz, Jr |
| 3,234,571 | A | 2/1966 | Buss |
| 3,347,066 | A | 10/1967 | Klausner |
| 3,498,091 | A | 3/1970 | Mason |
| 3,550,170 | A | 12/1970 | Davis |
| 3,697,727 | A | 10/1972 | Neuman et al. |
| 3,707,855 | A | 1/1973 | Buckley |
| 3,712,089 | A | 1/1973 | Toth |
| 3,801,077 | A | 4/1974 | Pearson |
| 3,830,241 | A | 8/1974 | Dye et al. |
| 3,869,815 | A | 3/1975 | Bullock |
| 3,890,987 | A | 6/1975 | Marcussen et al. |
| 3,935,719 | A | 2/1976 | Henderson |

(Continued)

FOREIGN PATENT DOCUMENTS

| | | |
|---|---|---|
| CA | 1330526 | 7/1994 |

(Continued)

*Primary Examiner* — Michael Barr
*Assistant Examiner* — Jason Riggleman
(74) *Attorney, Agent, or Firm* — Clifton G. Green; McGarry Bair PC

(57) ABSTRACT

A method of controlling the operation of a steam generator in a fabric treatment appliance may include controlling the operation of the steam generator in response to a rate of temperature change of the steam generator and/or controlling the operation of the steam generator in response to a rate of temperature change of a receptacle for receiving fabric items to be treated.

5 Claims, 6 Drawing Sheets

U.S. PATENT DOCUMENTS 4,034,583 A 7/1977 Miessler
4,045,174 A 8/1977 Fuhring et al.
4,108,000 A 8/1978 Norris
4,177,928 A 12/1979 Bergkvist
4,207,683 A 6/1980 Horton
4,214,148 A 7/1980 Fleischhauer
4,263,258 A 4/1981 Kalasek
4,332,047 A 6/1982 Kuttelwesch
4,373,430 A 2/1983 Allen
4,386,509 A 6/1983 Kuttelwesch
4,432,111 A 2/1984 Hoffmann et al.
4,489,574 A 12/1984 Spendel
4,496,473 A 1/1985 Sanderson
4,527,343 A 7/1985 Danneberg
4,646,630 A 3/1987 McCoy et al.
4,761,305 A 8/1988 Ochiai
4,777,682 A 10/1988 Dreher et al.
4,784,666 A 11/1988 Brenner et al.
4,809,597 A 3/1989 Lin
4,879,887 A 11/1989 Kagi et al.
4,920,668 A 5/1990 Henneberger et al.
4,987,627 A 1/1991 Cur et al.
4,991,545 A 2/1991 Rabe et al.
5,032,186 A 7/1991 Childers et al.
5,050,259 A 9/1991 Tsubaki et al.
5,052,344 A 10/1991 Kosugi et al.
5,058,194 A 10/1991 Violi
5,063,609 A 11/1991 Lorimer
5,107,606 A 4/1992 Tsubaki et al.
5,146,693 A 9/1992 Dottor et al.
5,152,252 A 10/1992 Bolton et al.
5,154,197 A 10/1992 Auld et al.
5,172,654 A 12/1992 Christiansen
5,172,888 A 12/1992 Ezekoye
5,199,455 A 4/1993 Dlouhy
5,212,969 A 5/1993 Tsubaki et al.
5,219,370 A 6/1993 Farrington et al.
5,219,371 A 6/1993 Shim et al.
5,279,676 A 1/1994 Oslin et al.
5,291,758 A 3/1994 Lee
5,293,761 A 3/1994 Jang
5,315,727 A 5/1994 Lee
5,345,637 A 9/1994 Pastryk et al.
5,460,161 A 10/1995 Englehart et al.
5,570,626 A 11/1996 Vos
5,619,983 A 4/1997 Smith
5,727,402 A 3/1998 Wada
5,732,664 A 3/1998 Badeaux, Jr.
5,743,034 A 4/1998 Debourg et al.
5,758,377 A 6/1998 Cimetta et al.
5,768,730 A 6/1998 Matsumoto et al.
5,774,627 A 6/1998 Jackson
5,815,637 A 9/1998 Allen et al.
6,029,300 A 2/2000 Kawaguchi et al.
6,067,403 A 5/2000 Morgandi
6,094,523 A 7/2000 Zelina et al.
6,122,849 A 9/2000 Kida et al.
6,161,306 A 12/2000 Clodic
6,178,671 B1 1/2001 Zwanenburg et al.
6,295,691 B1 10/2001 Chen
6,327,730 B1 12/2001 Corbett
6,434,857 B1 8/2002 Anderson et al.
6,451,066 B2 9/2002 Estes et al.
6,460,381 B1 10/2002 Yoshida et al.
6,585,781 B1 7/2003 Roseen
6,622,529 B1 9/2003 Crane
6,647,931 B1 11/2003 Morgandi et al.
6,691,536 B2 2/2004 Severns et al.
6,772,751 B2 8/2004 Deuringer et al.
6,789,404 B2 9/2004 Kim et al.
6,823,878 B1 11/2004 Gadini
6,874,191 B2 4/2005 Kim et al.
6,889,399 B2 5/2005 Steiner et al.
7,021,087 B2 4/2006 France et al.
7,096,828 B2 8/2006 Tippmann
7,290,412 B2 11/2007 Yang et al.
7,325,330 B2 2/2008 Kim et al.
7,404,304 B2 7/2008 Yang et al.
7,421,752 B2 9/2008 Donadon et al.
7,476,369 B2 * 1/2009 Yin et al. ..... 422/298
7,490,491 B2 2/2009 Yang et al.
7,490,493 B2 2/2009 Kim et al.
7,520,146 B2 4/2009 Kim et al.
7,600,402 B2 10/2009 Shin et al.
7,765,628 B2 8/2010 Wong et al.
2001/0032599 A1 10/2001 Fischer et al.
2003/0215226 A1 11/2003 Nomura et al.
2003/0226999 A1 12/2003 Hage
2004/0163184 A1 8/2004 Waldron et al.
2004/0187527 A1 9/2004 Kim et al.
2004/0187529 A1 9/2004 Kim et al.
2004/0200093 A1 10/2004 Wunderlin et al.
2004/0206480 A1 10/2004 Maydanik et al.
2004/0221474 A1 11/2004 Slutsky et al.
2004/0237603 A1 12/2004 Kim et al.
2004/0244432 A1 12/2004 Kim et al.
2004/0244438 A1 12/2004 North
2004/0255391 A1 * 12/2004 Kim et al. ..... 8/149.3
2005/0000031 A1 1/2005 Price et al.
2005/0028297 A1 2/2005 Kim et al.
2005/0034248 A1 2/2005 Oh et al.
2005/0034249 A1 2/2005 Oh et al.
2005/0034250 A1 2/2005 Oh et al.
2005/0034487 A1 2/2005 Oh et al.
2005/0034488 A1 2/2005 Oh et al.
2005/0034489 A1 2/2005 Oh et al.
2005/0034490 A1 2/2005 Oh et al.
2005/0050644 A1 3/2005 Severns et al.
2005/0072382 A1 4/2005 Tippmann, Sr.
2005/0072383 A1 4/2005 Powell et al.
2005/0092035 A1 5/2005 Shin et al.
2005/0132503 A1 6/2005 Yang et al.
2005/0132504 A1 6/2005 Yang et al.
2005/0132756 A1 6/2005 Yang et al.
2005/0144734 A1 7/2005 Yang et al.
2005/0144735 A1 7/2005 Yang et al.
2005/0205482 A1 9/2005 Gladney
2005/0220672 A1 10/2005 Takahashi et al.
2005/0223503 A1 10/2005 Hong et al.
2005/0223504 A1 10/2005 Lee et al.
2005/0252250 A1 11/2005 Oh et al.
2005/0262644 A1 12/2005 Oak et al.
2005/0284194 A1 12/2005 Kim et al.
2006/0000242 A1 1/2006 Yang et al.
2006/0001612 A1 1/2006 Kim
2006/0005581 A1 1/2006 Banba
2006/0010613 A1 1/2006 Jeon et al.
2006/0010727 A1 1/2006 Fung
2006/0010937 A1 1/2006 Kim et al.
2006/0016020 A1 1/2006 Park
2006/0090524 A1 5/2006 Jeon et al.
2006/0096333 A1 5/2006 Park et al.
2006/0101586 A1 5/2006 Park et al.
2006/0101588 A1 5/2006 Park et al.
2006/0101867 A1 5/2006 Kleker
2006/0107468 A1 5/2006 Urbanet et al.
2006/0112585 A1 6/2006 Choi et al.
2006/0117596 A1 6/2006 Kim et al.
2006/0130354 A1 6/2006 Choi et al.
2006/0137105 A1 6/2006 Hong et al.
2006/0137107 A1 6/2006 Lee et al.
2006/0150689 A1 7/2006 Kim et al.
2006/0151005 A1 7/2006 Kim et al.
2006/0151009 A1 7/2006 Kim et al.
2006/0191077 A1 8/2006 Oh et al.
2006/0191078 A1 8/2006 Kim et al.
2006/0277690 A1 12/2006 Pyo et al.
2007/0006484 A1 1/2007 Moschuetz et al.
2007/0028398 A1 2/2007 Kwon et al.
2007/0084000 A1 4/2007 Bernardino et al.
2007/0101773 A1 5/2007 Park et al.
2007/0107472 A1 5/2007 Kim et al.
2007/0107884 A1 5/2007 Sirkar et al.
2007/0125133 A1 6/2007 Oh et al.
2007/0130697 A1 6/2007 Oh et al.
2007/0130698 A1 6/2007 Kim
2007/0136956 A1 6/2007 Kim et al.

| | | | |
|---|---|---|---|
| 2007/0137262 | A1 | 6/2007 | Kim et al. |
| 2007/0169279 | A1 | 7/2007 | Park et al. |
| 2007/0169280 | A1 | 7/2007 | Kim et al. |
| 2007/0169282 | A1 | 7/2007 | Kim |
| 2007/0169521 | A1 | 7/2007 | Kim et al. |
| 2007/0180628 | A1 | 8/2007 | Ahn |
| 2007/0186591 | A1 | 8/2007 | Kim et al. |
| 2007/0186592 | A1 | 8/2007 | Kim et al. |
| 2007/0186593 | A1 | 8/2007 | Ahn |
| 2007/0199353 | A1 | 8/2007 | Woo et al. |
| 2007/0240458 | A1 | 10/2007 | Kim et al. |
| 2007/0283505 | A1 | 12/2007 | Wong et al. |
| 2007/0283508 | A1 | 12/2007 | Wong et al. |
| 2007/0283509 | A1 | 12/2007 | Wong et al. |
| 2007/0283728 | A1 | 12/2007 | Wong et al. |
| 2008/0006063 | A1 | 1/2008 | Ahn et al. |
| 2008/0006300 | A1* | 1/2008 | Ahn et al. ..... 134/18 |
| 2008/0019864 | A1 | 1/2008 | Savage et al. |
| 2008/0028801 | A1 | 2/2008 | Czyzewski et al. |
| 2008/0115740 | A1 | 5/2008 | You |
| 2009/0056034 | A1 | 3/2009 | Herkle et al. |
| 2009/0056036 | A1 | 3/2009 | Herkle et al. |
| 2009/0056762 | A1 | 3/2009 | Pinkowski et al. |

FOREIGN PATENT DOCUMENTS

| | | | |
|---|---|---|---|
| CN | 1664222 | A | 9/2005 |
| CN | 1962988 | A | 5/2007 |
| CN | 1962998 | A | 5/2007 |
| CN | 1965123 | A | 5/2007 |
| CN | 101003939 | A | 7/2007 |
| CN | 101008148 | A | 8/2007 |
| CN | 101024915 | A | 8/2007 |
| DE | 12203 | | 2/1881 |
| DE | 42920 | | 4/1888 |
| DE | 69929 | | 8/1893 |
| DE | 132104 | | 7/1902 |
| DE | 176355 | | 10/1906 |
| DE | 243328 | | 2/1912 |
| DE | 283533 | | 4/1915 |
| DE | 317887 | | 1/1920 |
| DE | 427025 | | 3/1926 |
| DE | 435088 | | 10/1926 |
| DE | 479594 | | 7/1929 |
| DE | 668963 | | 12/1938 |
| DE | 853433 | | 10/1952 |
| DE | 894685 | | 10/1953 |
| DE | 1847016 | | 2/1962 |
| DE | 1873622 | | 6/1963 |
| DE | 2202345 | | 8/1973 |
| DE | 2226373 | | 12/1973 |
| DE | 2245532 | | 3/1974 |
| DE | 7340082 | | 5/1975 |
| DE | 2410107 | | 9/1975 |
| DE | 2533759 | | 2/1977 |
| DE | 3103529 | A1 | 8/1982 |
| DE | 3139466 | A1 | 4/1983 |
| DE | 3408136 | | 9/1985 |
| DE | 3501008 | A1 | 7/1986 |
| DE | 3627988 | | 4/1987 |
| DE | 8703344 | | 8/1988 |
| DE | 4116673 | A1 | 11/1992 |
| DE | 4225847 | | 2/1994 |
| DE | 4413213 | | 10/1995 |
| DE | 4443338 | | 6/1996 |
| DE | 29707168 | | 7/1997 |
| DE | 19730422 | A1 | 1/1999 |
| DE | 19736794 | A1 | 2/1999 |
| DE | 19742282 | | 2/1999 |
| DE | 19743508 | | 4/1999 |
| DE | 19751028 | | 5/1999 |
| DE | 19903951 | | 8/2000 |
| DE | 10028944 | | 12/2001 |
| DE | 10035904 | | 1/2002 |
| DE | 10039904 | | 2/2002 |
| DE | 10043165 | | 2/2002 |
| DE | 10312163 | | 11/2003 |
| DE | 10260163 | A1 | 7/2004 |
| DE | 102005051721 | A1 | 5/2007 |
| DE | 102007023020 | B3 | 5/2008 |
| EP | 0043122 | | 1/1982 |
| EP | 0132884 | | 2/1985 |
| EP | 0135484 | A2 | 3/1985 |
| EP | 0217981 | | 4/1987 |
| EP | 0222264 | | 5/1987 |
| EP | 0280782 | | 9/1988 |
| EP | 0284554 | | 9/1988 |
| EP | 0287990 | | 10/1988 |
| EP | 0302125 | | 8/1989 |
| EP | 363708 | | 4/1990 |
| EP | 0383327 | | 8/1990 |
| EP | 0404253 | A1 | 12/1990 |
| EP | 0511525 | | 11/1992 |
| EP | 0574341 | A1 | 12/1993 |
| EP | 0582092 | A1 | 2/1994 |
| EP | 0638684 | A1 | 2/1995 |
| EP | 0672377 | A1 | 9/1995 |
| EP | 0726349 | A2 | 8/1996 |
| EP | 0768059 | | 4/1997 |
| EP | 0785303 | A1 | 7/1997 |
| EP | 0808936 | | 11/1997 |
| EP | 0821096 | A1 | 1/1998 |
| EP | 0839943 | A1 | 5/1998 |
| EP | 0816550 | | 7/1998 |
| EP | 1163387 | | 12/2001 |
| EP | 1275767 | | 1/2003 |
| EP | 1351016 | | 10/2003 |
| EP | 1411163 | | 4/2004 |
| EP | 1437547 | | 7/2004 |
| EP | 1441059 | | 7/2004 |
| EP | 1441175 | | 7/2004 |
| EP | 1464750 | | 10/2004 |
| EP | 1464751 | | 10/2004 |
| EP | 1469120 | | 10/2004 |
| EP | 1505193 | A2 | 2/2005 |
| EP | 1507028 | | 2/2005 |
| EP | 1507029 | | 2/2005 |
| EP | 1507030 | | 2/2005 |
| EP | 1507031 | | 2/2005 |
| EP | 1507032 | | 2/2005 |
| EP | 1507033 | | 2/2005 |
| EP | 1529875 | | 5/2005 |
| EP | 1544345 | | 6/2005 |
| EP | 1548175 | | 6/2005 |
| EP | 1550760 | | 7/2005 |
| EP | 1555338 | | 7/2005 |
| EP | 1555340 | | 7/2005 |
| EP | 1561853 | | 8/2005 |
| EP | 1584728 | | 10/2005 |
| EP | 1616990 | A1 * | 1/2006 |
| EP | 1619284 | A1 | 1/2006 |
| EP | 1655408 | A1 | 5/2006 |
| EP | 1659205 | A2 | 5/2006 |
| EP | 1666655 | A2 | 6/2006 |
| EP | 1681384 | A1 | 7/2006 |
| EP | 1696066 | A2 | 8/2006 |
| EP | 1731840 | | 12/2006 |
| EP | 1746197 | A2 | 1/2007 |
| EP | 1783262 | A2 | 5/2007 |
| EP | 1555339 | | 8/2007 |
| EP | 1813704 | A1 | 8/2007 |
| EP | 1813709 | A2 | 8/2007 |
| EP | 1865099 | A1 | 12/2007 |
| EP | 1865101 | A1 | 12/2007 |
| EP | 1889966 | A2 | 2/2008 |
| EP | 1936023 | A1 | 6/2008 |
| FR | 2306400 | | 10/1976 |
| FR | 2525645 | A1 | 10/1983 |
| FR | 2581442 | | 11/1986 |
| FR | 2688807 | A1 | 9/1993 |
| GB | 21286 | | 8/1898 |
| GB | 10423 | | 11/1909 |
| GB | 21024 | | 2/1910 |
| GB | 191010567 | A | 4/1911 |
| GB | 191010792 | A | 4/1911 |
| GB | 191022943 | A | 8/1911 |
| GB | 191024005 | A | 10/1911 |
| GB | 191103554 | A | 12/1911 |
| GB | 102466 | A | 12/1916 |

| | | | |
|---|---|---|---|
| GB | 285384 | A | 11/1928 |
| GB | 397236 | | 8/1933 |
| GB | 514440 | A | 11/1939 |
| GB | 685813 | | 1/1953 |
| GB | 799788 | | 8/1958 |
| GB | 835250 | | 5/1960 |
| GB | 881083 | | 11/1961 |
| GB | 889500 | A | 2/1962 |
| GB | 1155268 | A | 6/1969 |
| GB | 1331623 | | 9/1973 |
| GB | 1352955 | | 5/1974 |
| GB | 1366852 | A | 9/1974 |
| GB | 2219603 | A | 12/1989 |
| GB | 2309071 | A | 7/1997 |
| GB | 2348213 | | 9/2000 |
| JP | 35021275 | | 8/1950 |
| JP | 36023044 | | 9/1960 |
| JP | 36000067 | | 7/1961 |
| JP | 52146973 | | 12/1977 |
| JP | 54068072 | A | 5/1979 |
| JP | 57094480 | | 6/1982 |
| JP | 57032858 | | 7/1982 |
| JP | 60138399 | | 7/1985 |
| JP | 61128995 | | 6/1986 |
| JP | 62066891 | | 3/1987 |
| JP | 2049700 | A | 2/1990 |
| JP | 02161997 | | 6/1990 |
| JP | 02026465 | | 7/1990 |
| JP | 02198595 | | 8/1990 |
| JP | 2239894 | | 9/1990 |
| JP | 2242088 | A | 9/1990 |
| JP | 02267402 | | 11/1990 |
| JP | 03025748 | | 6/1991 |
| JP | 3137401 | A | 6/1991 |
| JP | 4020396 | A | 1/1992 |
| JP | 04158896 | | 6/1992 |
| JP | 4158896 | A | 6/1992 |
| JP | 05023493 | | 2/1993 |
| JP | 05115672 | A | 5/1993 |
| JP | 05146583 | | 6/1993 |
| JP | 05269294 | | 10/1993 |
| JP | 5346485 | A | 12/1993 |
| JP | 06123360 | | 5/1994 |
| JP | 08261689 | | 10/1996 |
| JP | 9133305 | A | 5/1997 |
| JP | 10235088 | A | 9/1998 |
| JP | 11047488 | | 2/1999 |
| JP | 11164979 | | 6/1999 |
| JP | 11164980 | | 6/1999 |
| JP | 11226290 | | 8/1999 |
| JP | 2000176192 | | 6/2000 |
| JP | 2003019382 | | 1/2003 |
| JP | 2003093775 | | 4/2003 |
| JP | 2003311068 | | 11/2003 |
| JP | 2003311084 | | 11/2003 |
| JP | 2003320324 | | 11/2003 |
| JP | 2003326077 | | 11/2003 |
| JP | 2004061011 | A | 2/2004 |
| JP | 2004121666 | | 4/2004 |
| JP | 2004167131 | | 6/2004 |
| JP | 2004298614 | | 10/2004 |
| JP | 2004298616 | | 10/2004 |
| JP | 2004313793 | | 11/2004 |
| JP | 2005058740 | | 3/2005 |
| JP | 2005058741 | | 3/2005 |
| JP | 2005177440 | | 7/2005 |
| JP | 2005177445 | | 7/2005 |
| JP | 2005177450 | | 7/2005 |
| JP | 2005192997 | | 7/2005 |
| JP | 2005193003 | | 7/2005 |
| JP | 2006109886 | | 4/2006 |
| JP | 2006130295 | A | 5/2006 |
| KR | 9319820 | | 9/1993 |
| KR | 1019950018856 | | 7/1995 |
| KR | 1019970011098 | | 3/1997 |
| KR | 1019970070295 | | 11/1997 |
| KR | 2019970039170 | | 7/1998 |
| KR | 200128631 | | 8/1998 |
| KR | 100146947 | | 10/1998 |
| KR | 20010015043 | | 2/2001 |
| KR | 10220010010111 | | 2/2001 |
| KR | 20040085509 | A | 10/2004 |
| KR | 20050017481 | A | 2/2005 |
| KR | 20060031165 | | 4/2006 |
| WO | 9214954 | | 9/1992 |
| WO | 9307798 | A1 | 4/1993 |
| WO | 93/19237 | A1 | 9/1993 |
| WO | 9715709 | | 5/1997 |
| WO | 9803175 | | 1/1998 |
| WO | 0111134 | | 2/2001 |
| WO | 0174129 | A2 | 10/2001 |
| WO | 2001074129 | A2 | 10/2001 |
| WO | 03012185 | | 2/2003 |
| WO | 03012185 | A2 | 2/2003 |
| WO | 2003012185 | A2 | 2/2003 |
| WO | 03057966 | | 7/2003 |
| WO | 2004059070 | | 7/2004 |
| WO | 2004091359 | A2 | 10/2004 |
| WO | 2005001189 | A1 | 1/2005 |
| WO | 2005018837 | A1 | 3/2005 |
| WO | 2005115095 | | 12/2005 |
| WO | 2006001612 | | 1/2006 |
| WO | 2006009364 | A1 | 1/2006 |
| WO | WO/2006/101361 | A1 * | 3/2006 |
| WO | 2006/070317 | A1 | 7/2006 |
| WO | 2006090973 | | 8/2006 |
| WO | 2006091054 | | 8/2006 |
| WO | 2006091057 | A1 | 8/2006 |
| WO | 2006098571 | | 9/2006 |
| WO | 2006098572 | | 9/2006 |
| WO | 2006098573 | | 9/2006 |
| WO | 2006101304 | | 9/2006 |
| WO | 2006101312 | | 9/2006 |
| WO | 2006101336 | | 9/2006 |
| WO | 2006101345 | | 9/2006 |
| WO | 2006101358 | | 9/2006 |
| WO | 2006101360 | | 9/2006 |
| WO | 2006101361 | | 9/2006 |
| WO | 2006101362 | | 9/2006 |
| WO | 2006101363 | | 9/2006 |
| WO | 2006101365 | | 9/2006 |
| WO | 2006101372 | | 9/2006 |
| WO | 2006101376 | | 9/2006 |
| WO | 2006101377 | | 9/2006 |
| WO | 2006104310 | | 10/2006 |
| WO | 2006112611 | | 10/2006 |
| WO | 2006126778 | A1 | 11/2006 |
| WO | 2006126779 | A1 | 11/2006 |
| WO | 2006126799 | A2 | 11/2006 |
| WO | 2006126803 | A2 | 11/2006 |
| WO | 2006126804 | A2 | 11/2006 |
| WO | 2006126810 | A2 | 11/2006 |
| WO | 2006126811 | A2 | 11/2006 |
| WO | 2006126813 | A2 | 11/2006 |
| WO | 2006126815 | A2 | 11/2006 |
| WO | 2006129912 | A1 | 12/2006 |
| WO | 2006129913 | A1 | 12/2006 |
| WO | 2006129915 | A1 | 12/2006 |
| WO | 2006129916 | A1 | 12/2006 |
| WO | 2007/007241 | A1 | 1/2007 |
| WO | 2007004785 | A1 | 1/2007 |
| WO | 2007010327 | A1 | 1/2007 |
| WO | 2007024050 | A1 | 3/2007 |
| WO | 2007024056 | A1 | 3/2007 |
| WO | 2007024057 | A1 | 3/2007 |
| WO | 2007026989 | A1 | 3/2007 |
| WO | 2007026990 | A1 | 3/2007 |
| WO | 2007055475 | A1 | 5/2007 |
| WO | 2007055510 | A1 | 5/2007 |
| WO | 2007058477 | A1 | 5/2007 |
| WO | 2007073012 | A1 | 6/2007 |
| WO | 2007073013 | A1 | 6/2007 |
| WO | 2007081069 | A1 | 7/2007 |
| WO | 2007086672 | A1 | 8/2007 |
| WO | 2007/116255 | A1 | 10/2007 |
| WO | 2007145448 | A2 | 12/2007 |
| WO | 2008004801 | A2 | 1/2008 |

* cited by examiner

METHOD FOR DETECTING ABNORMALITY IN A FABRIC TREATMENT APPLIANCE HAVING A STEAM GENERATOR

BACKGROUND OF THE INVENTION

1. Field of the Invention

The invention relates to detecting abnormality in a fabric treatment appliance having a steam generator.

2. Description of the Related Art

Some fabric treatment appliances, such as a washing machine, a clothes dryer, and a fabric refreshing or revitalizing machine, use steam generators for various reasons. The steam from the steam generator can be used to, for example, heat water, heat a load of fabric items and any water absorbed by the fabric items, dewrinkle fabric items, remove odors from fabric items, sanitize the fabric items, and sanitize components of the fabric treatment appliance.

A common problem associated with steam generators involves the formation of deposits, such as scale and sludge, within the steam generation chamber. Water supplies for many households may contain dissolved substances, such as calcium and magnesium, which can lead to the formation of deposits in the steam generation chamber when the water is heated. Scale and sludge are, respectively, hard and soft deposits; in some conditions, the hard scale tends to deposit on the inner walls of the structure forming the steam generation chamber, and the soft sludge can settle to the bottom of the steam generator. In addition to calcification of the steam generator, other problems associated with steam generators can include blockage or leaking of hoses coupling a water supply to the steam generator and coupling the steam generator to a fabric treatment receptacle, such as a tub of a washing machine, a closed or blocked water tap or water supply, and undervoltage of the steam generator heater, which can lead to low steam generating efficiency. If undetected, such problems can irritate users of the fabric treatment appliance and/or reduce operational life of the steam generator.

SUMMARY OF THE INVENTION

A method according to one embodiment of the invention of controlling the operation of a steam generator in a fabric treatment appliance comprises controlling the operation of the steam generator in response to a rate of temperature change of the steam generator.

DESCRIPTION OF EMBODIMENTS OF THE INVENTION

Figure 1:
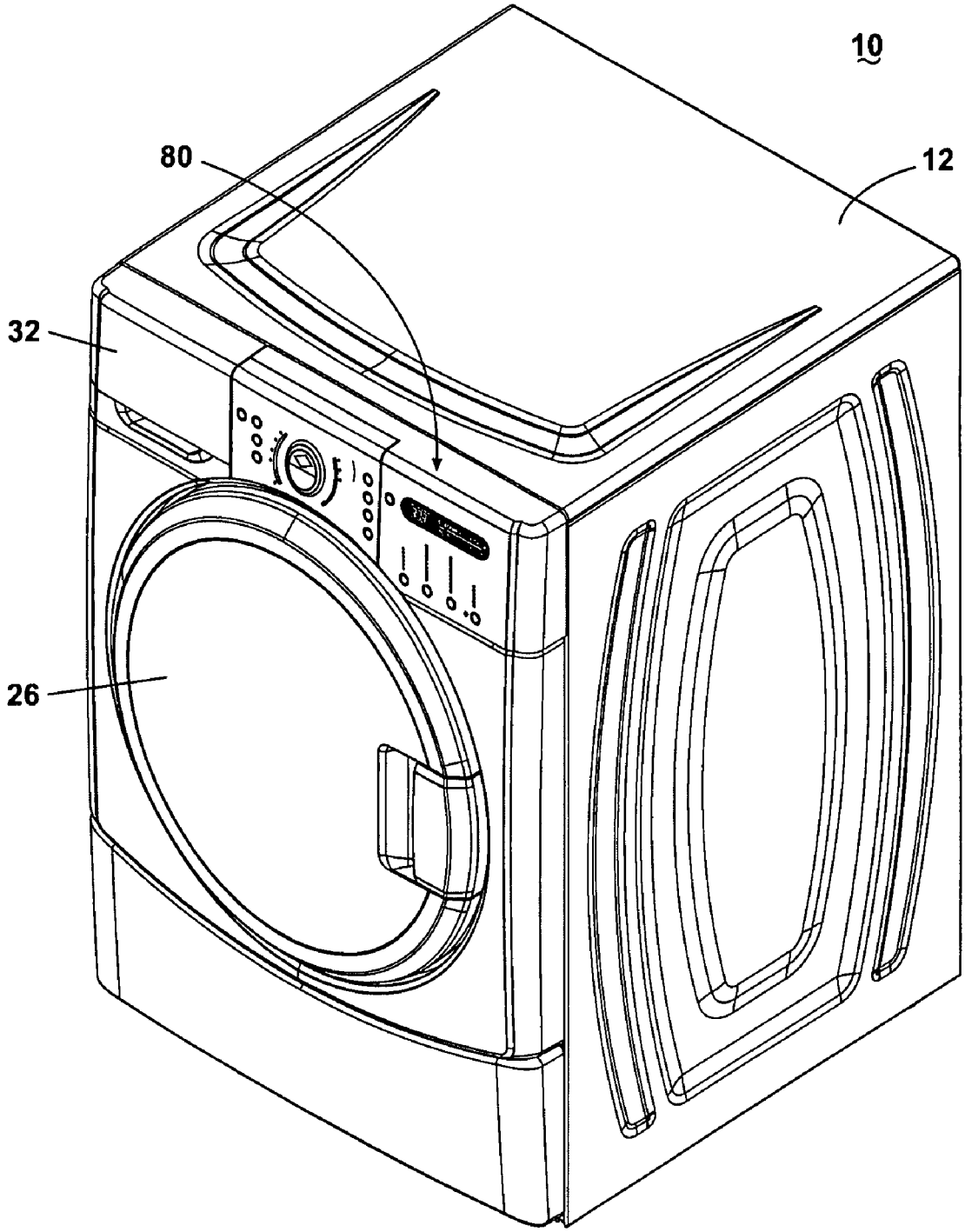
FIG. 1 is a perspective view of an exemplary fabric treatment appliance in the form of a washing machine according to one embodiment of the invention.

Referring now to the figures, FIG. 1 is a schematic view of an exemplary fabric treatment appliance in the form of a washing machine 10 according to one embodiment of the invention. The fabric treatment appliance may be any machine that treats fabrics, and examples of the fabric treatment appliance may include, but are not limited to, a washing machine, including top-loading, front-loading, vertical axis, and horizontal axis washing machines; a dryer, such as a tumble dryer or a stationary dryer, including top-loading dryers and front-loading dryers; a combination washing machine and dryer; a tumbling or stationary refreshing/revitalizing machine; an extractor; a non-aqueous washing apparatus; and a revitalizing machine. For illustrative purposes, the invention will be described with respect to a washing machine with the fabric being a clothes load, with it being understood that the invention may be adapted for use with any type of fabric treatment appliance for treating fabric and to other appliances, such as dishwashers, irons, and cooking appliances, including ovens, food steamers, and microwave ovens, employing a steam generator.

Figure 2:
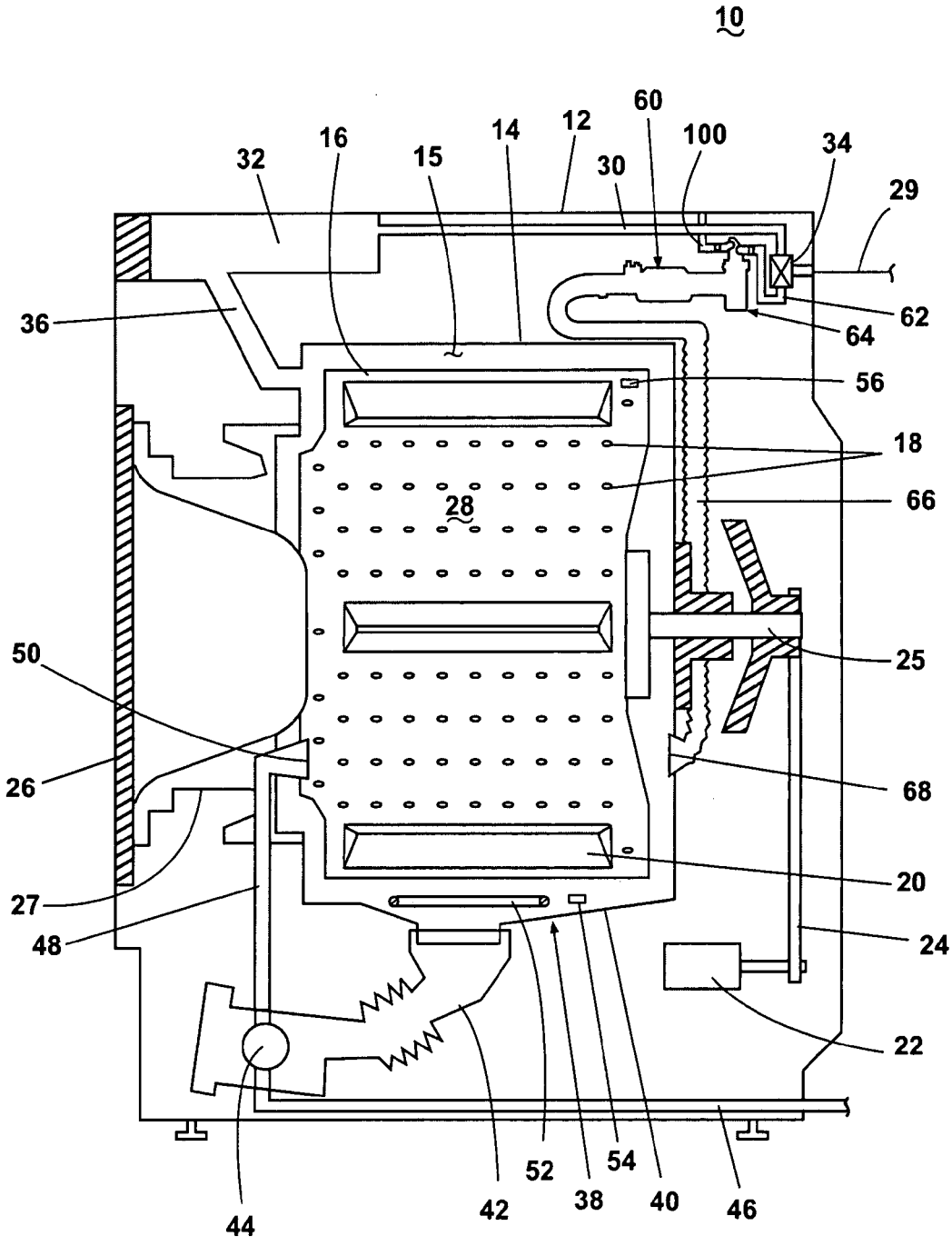
FIG. 2 is a schematic view of the fabric treatment appliance of FIG. 1.

FIG. 2 provides a schematic view of the fabric treatment appliance of FIG. 1. The washing machine 10 of the illustrated embodiment may include a cabinet 12 that houses a stationary tub 14, which defines an interior chamber 15. A rotatable drum 16 mounted within the interior chamber 15 of the tub 14 may include a plurality of perforations 18, and liquid may flow between the tub 14 and the drum 16 through the perforations 18. The drum 16 may further include a plurality of baffles 20 disposed on an inner surface of the drum 16 to lift fabric items contained in the drum 16 while the drum 16 rotates, as is well known in the washing machine art. A motor 22 coupled to the drum 16 through a belt 24 and a drive shaft 25 may rotate the drum 16. Alternately, the motor 22 may be directly coupled with the drive shaft 25 as is known in the art. Both the tub 14 and the drum 16 may be selectively closed by a door 26. A bellows 27 couples an open face of the tub 14 with the cabinet 12, and the door 26 seals against the bellows 27 when the door 26 closes the tub 14. The drum 16 may define a cleaning chamber 28 for receiving fabric items to be cleaned.

The tub 14 and/or the drum 16 may be considered a receptacle, and the receptacle may define a treatment chamber for receiving fabric items to be treated. While the illustrated washing machine 10 includes both the tub 14 and the drum 16, it is within the scope of the invention for the fabric treatment appliance to include only one receptacle, with the receptacle defining the treatment chamber for receiving the fabric items to be treated.

Washing machines are typically categorized as either a vertical axis washing machine or a horizontal axis washing machine. As used herein, the "vertical axis" washing machine refers to a washing machine having a rotatable drum that rotates about a generally vertical axis relative to a surface that supports the washing machine. Typically, the drum is perforate or imperforate and holds fabric items and a fabric moving element, such as an agitator, impeller, nutator, and the like, that induces movement of the fabric items to impart mechanical energy to the fabric articles for cleaning action. However, the rotational axis need not be vertical. The drum can rotate about an axis inclined relative to the vertical axis. As used herein, the "horizontal axis" washing machine refers to a washing machine having a rotatable drum that rotates about a generally horizontal axis relative to a surface that supports the washing machine. The drum may be perforated or imperforate, holds fabric items, and typically washes the fabric items by the fabric items rubbing against one another and/or hitting the surface of the drum as the drum rotates. In horizontal axis washing machines, the clothes are lifted by the rotating drum and then fall in response to gravity to form a tumbling action that imparts the mechanical energy to the fabric articles. In some horizontal axis washing machines, the drum rotates about a horizontal axis generally parallel to a surface that supports the washing machine. However, the rotational axis need not be horizontal. The drum can rotate about an axis inclined relative to the horizontal axis, with fifteen degrees of inclination being one example of inclination.

Vertical axis and horizontal axis machines are best differentiated by the manner in which they impart mechanical energy to the fabric articles. In vertical axis machines, the fabric moving element moves within a drum to impart mechanical energy directly to the clothes or indirectly through wash liquid in the drum. The clothes mover is typically moved in a reciprocating rotational movement. In horizontal axis machines mechanical energy is imparted to the clothes by the tumbling action formed by the repeated lifting and dropping of the clothes, which is typically implemented by the rotating drum. The illustrated exemplary washing machine of FIGS. 1 and 2 is a horizontal axis washing machine.

With continued reference to FIG. 2, the motor 22 may rotate the drum 16 at various speeds in opposite rotational directions. In particular, the motor 22 may rotate the drum 16 at tumbling speeds wherein the fabric items in the drum 16 rotate with the drum 16 from a lowest location of the drum 16 towards a highest location of the drum 16, but fall back to the lowest location of the drum 16 before reaching the highest location of the drum 16. The rotation of the fabric items with the drum 16 may be facilitated by the baffles 20. Typically, the radial force applied to the fabric items at the tumbling speeds may be less than about 1 G. Alternatively, the motor 22 may rotate the drum 16 at spin speeds wherein the fabric items rotate with the drum 16 without falling. In the washing machine art, the spin speeds may also be referred to as satellizing speeds or sticking speeds. Typically, the force applied to the fabric items at the spin speeds may be greater than or about equal to 1 G. As used herein, "tumbling" of the drum 16 refers to rotating the drum at a tumble speed, "spinning" the drum 16 refers to rotating the drum 16 at a spin speed, and "rotating" of the drum 16 refers to rotating the drum 16 at any speed.

The washing machine 10 of FIG. 2 may further include a liquid supply and recirculation system. Liquid, such as water, may be supplied to the washing machine 10 from a water supply 29, such as a household water supply. A first supply conduit 30 may fluidly couple the water supply 29 to a detergent dispenser 32. An inlet valve 34 may control flow of the liquid from the water supply 29 and through the first supply conduit 30 to the detergent dispenser 32. The inlet valve 34 may be positioned in any suitable location between the water supply 29 and the detergent dispenser 32. A liquid conduit 36 may fluidly couple the detergent dispenser 32 with the tub 14. The liquid conduit 36 may couple with the tub 14 at any suitable location on the tub 14 and is shown as being coupled to a front wall of the tub 14 in FIG. 1 for exemplary purposes. The liquid that flows from the detergent dispenser 32 through the liquid conduit 36 to the tub 14 typically enters a space between the tub 14 and the drum 16 and may flow by gravity to a sump 38 formed in part by a lower portion 40 of the tub 14. The sump 38 may also be formed by a sump conduit 42 that may fluidly couple the lower portion 40 of the tub 14 to a pump 44. The pump 44 may direct fluid to a drain conduit 46, which may drain the liquid from the washing machine 10, or to a recirculation conduit 48, which may terminate at a recirculation inlet 50. The recirculation inlet 50 may direct the liquid from the recirculation conduit 48 into the drum 16. The recirculation inlet 50 may introduce the liquid into the drum 16 in any suitable manner, such as by spraying, dripping, or providing a steady flow of the liquid.

The exemplary washing machine 10 may further include a steam generation system. The steam generation system may include a steam generator 60 that may receive liquid from the water supply 29 through a second supply conduit 62, optionally via a reservoir 64. The inlet valve 34 may control flow of the liquid from the water supply 29 and through the second supply conduit 62 and the reservoir 64 to the steam generator 60. The inlet valve 34 may be positioned in any suitable location between the water supply 29 and the steam generator 60. A steam conduit 66 may fluidly couple the steam generator 60 to a steam inlet 68, which may introduce steam into the tub 14. The steam inlet 68 may couple with the tub 14 at any suitable location on the tub 14 and is shown as being coupled to a rear wall of the tub 14 in FIG. 2 for exemplary purposes. The steam that enters the tub 14 through the steam inlet 68 may subsequently enter the drum 16 through the perforations 18. Alternatively, the steam inlet 68 may be configured to introduce the steam directly into the drum 16. The steam inlet 68 may introduce the steam into the tub 14 in any suitable manner.

An optional sump heater 52 may be located in the sump 38. The sump heater 52 may be any type of heater and is illustrated as a resistive heating element for exemplary purposes. The sump heater 52 may be used alone or in combination with the steam generator 60 to add heat to the chamber 15. Typically, the sump heater 52 adds heat to the chamber 15 by heating water in the sump 38. The tub 14 may further include a temperature sensor 54, which may be located in the sump 38 or in another suitable location in the tub 14. The temperature sensor 54 may sense the temperature of water in the sump 38, if the sump 38 contains water, or a general temperature of the tub 14 or interior of the tub 14. The tub 14 may alternatively or additionally have a temperature sensor 56 located outside the sump 38 to sense a general temperature of the tub or interior of the tub 14. The temperature sensors 54, 56 may be any type of temperature sensors, which are well-known to one skilled in the art. Exemplary temperature sensors for use as the temperature sensors 54, 56 include thermistors, such as a negative temperature coefficient (NTC) thermistor.

The washing machine 10 may further include an exhaust conduit (not shown) that may direct steam that leaves the tub 14 externally of the washing machine 10. The exhaust conduit may be configured to exhaust the steam directly to the exterior of the washing machine 10. Alternatively, the exhaust conduit may be configured to direct the steam through a condenser prior to leaving the washing machine 10. Examples of exhaust systems are disclosed in the following patent applications, which are incorporated herein by reference in their entirety: U.S. patent application Ser. No. 11/464,506, titled "Fabric Treating Appliance Utilizing Steam," U.S. patent application Ser. No. 11/464,501, titled "A Steam Fabric Treatment Appliance with Exhaust," U.S. patent application Ser. No. 11/464,521, titled "Steam Fabric Treatment Appliance with Anti-Siphoning," and U.S. patent application Ser. No. 11/464,520, titled "Determining Fabric Temperature in a Fabric Treating Appliance," all filed Aug. 15, 2006.

The steam generator 60 may be any type of device that converts the liquid to steam. For example, the steam generator 60 may be a tank-type steam generator that stores a volume of liquid and heats the volume of liquid to convert the liquid to steam. Alternatively, the steam generator 60 may be an in-line steam generator that converts the liquid to steam as the liquid flows through the steam generator 60. As another alternative, the steam generator 60 may utilize the sump heater 52 or other heating device located in the sump 38 to heat liquid in the sump 38. The steam generator 60 may produce pressurized or non-pressurized steam.

Exemplary steam generators are disclosed in U.S. patent application Ser. No. 11/464,528, titled "Removal of Scale and Sludge in a Steam Generator of a Fabric Treatment Appliance," U.S. patent application Ser. No. 11/450,836, titled "Prevention of Scale and Sludge in a Steam Generator of a Fabric Treatment Appliance," and U.S. patent application Ser. No. 11/450,714, titled "Draining Liquid From a Steam Generator of a Fabric Treatment Appliance," all filed Jun. 9, 2006, in addition to U.S. patent application Ser. No. 11/464,509, titled "Water Supply Control for a Steam Generator of a Fabric Treatment Appliance," U.S. patent application Ser. No. 11/464,514, titled "Water Supply Control for a Steam Generator of a Fabric Treatment Appliance Using a Weight Sensor," and U.S. patent application Ser. No. 11/464,513, titled "Water Supply Control for a Steam Generator of a Fabric Treatment Appliance Using a Temperature Sensor," all filed Aug. 15, 2006, which are incorporated herein by reference in their entirety.

In addition to producing steam, the steam generator 60, whether an in-line steam generator, a tank-type steam generator, or any other type of steam generator, may heat water to a temperature below a steam transformation temperature, whereby the steam generator 60 produces heated water. The heated water may be delivered to the tub 14 and/or drum 16 from the steam generator 60. The heated water may be used alone or may optionally mix with cold or warm water in the tub 14 and/or drum 16. Using the steam generator 60 to produce heated water may be useful when the steam generator 60 couples only with a cold water source of the water supply 29. Optionally, the steam generator 60 may be employed to simultaneously supply steam and heated water to the tub 14 and/or drum 16.

The liquid supply and recirculation system and the steam generation system may differ from the configuration shown in FIG. 2, such as by inclusion of other valves, conduits, wash aid dispensers, and the like, to control the flow of liquid and steam through the washing machine 10 and for the introduction of more than one type of detergent/wash aid. For example, a valve may be located in the liquid conduit 36, in the recirculation conduit 48, and in the steam conduit 66. Furthermore, an additional conduit may be included to couple the water supply 29 directly to the tub 14 or the drum 16 so that the liquid provided to the tub 14 or the drum 16 does not have to pass through the detergent dispenser 32. Alternatively, the liquid may be provided to the tub 14 or the drum 16 through the steam generator 60 rather than through the detergent dispenser 32 or the additional conduit. As another example, the liquid conduit 36 may be configured to supply liquid directly into the drum 16, and the recirculation conduit 48 may be coupled to the liquid conduit 36 so that the recirculated liquid enters the tub 14 or the drum 16 at the same location where the liquid from the detergent dispenser 32 enters the tub 14 or the drum 16.

Other alternatives for the liquid supply and recirculation system are disclosed in U.S. patent application Ser. No. 11/450,636, titled "Method of Operating a Washing Machine Using Steam;" U.S. patent application Ser. No. 11/450,529, titled "Steam Washing Machine Operation Method Having Dual Speed Spin Pre-Wash;" and U.S. patent application Ser. No. 11/450,620, titled "Steam Washing Machine Operation Method Having Dry Spin Pre-Wash," all filed Jun. 9, 2006, which are incorporated herein by reference in their entirety.

Figure 3:
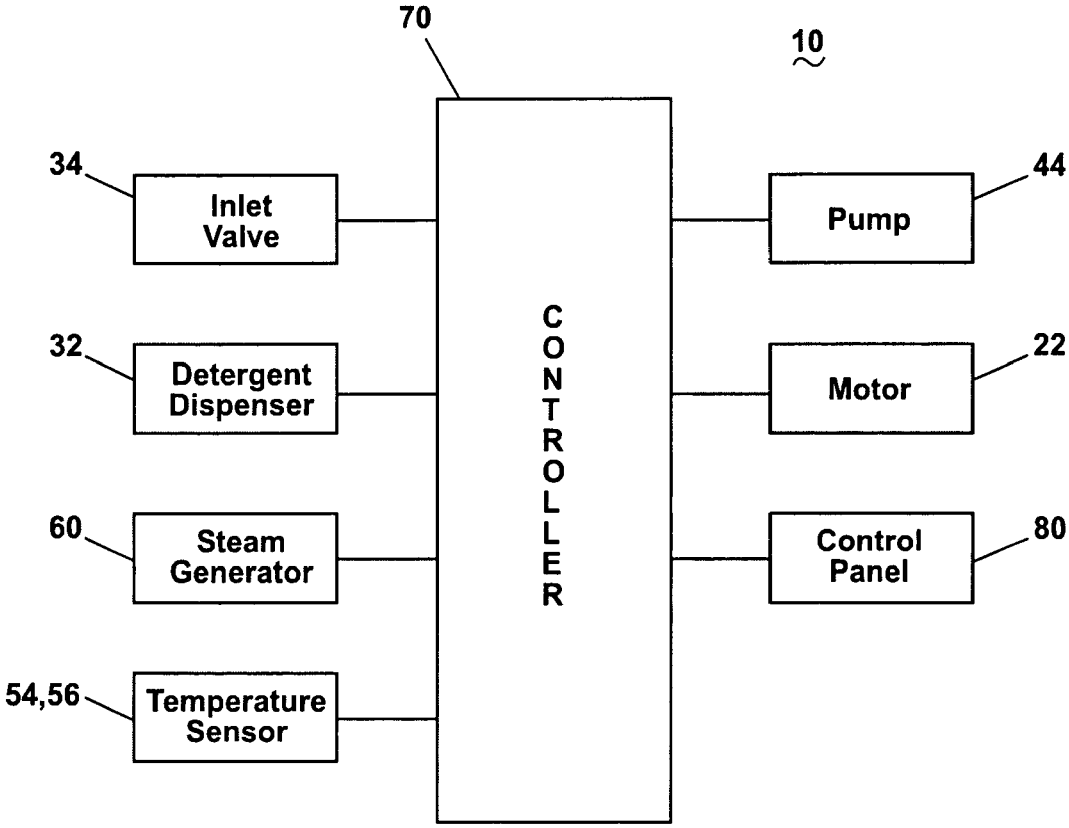
FIG. 3 is a schematic view of an exemplary control system of the fabric treatment appliance of FIG. 1.

Referring now to FIG. 3, which is a schematic view of an exemplary control system of the washing machine 10, the washing machine 10 may further include a controller 70 coupled to various working components of the washing machine 10, such as the pump 44, the motor 22, the inlet valve 34, the detergent dispenser 32, and the steam generator 60, to control the operation of the washing machine 10. If the optional sump heater 52 is used, the controller may also control the operation of the sump heater 52. The controller 70 may receive data from one or more of the working components or sensors, such as the temperature sensors 54, 56, and may provide commands, which can be based on the received data, to one or more of the working components to execute a desired operation of the washing machine 10. The commands may be data and/or an electrical signal without data. A control panel 80 may be coupled to the controller 70 and may provide for input/output to/from the controller 70. In other words, the control panel 80 may perform a user interface function through which a user may enter input related to the operation of the washing machine 10, such as selection and/or modification of an operation cycle of the washing machine 10, and receive output related to the operation of the washing machine 10.

Many known types of controllers may be used for the controller 70. The specific type of controller is not germane to the invention. It is contemplated that the controller is a microprocessor-based controller that implements control software and sends/receives one or more electrical signals to/from each of the various components (inlet valve 34, detergent dispenser 32, steam generator 60, pump 44, motor 22, control panel 80, and temperature sensors 54, 56) to effect the control software. As an example, proportional control (P), proportional integral control (PI), and proportional derivative control (PD), or a combination thereof, a proportional integral derivative control (PID control), may be used to control the various components.

Figure 4:
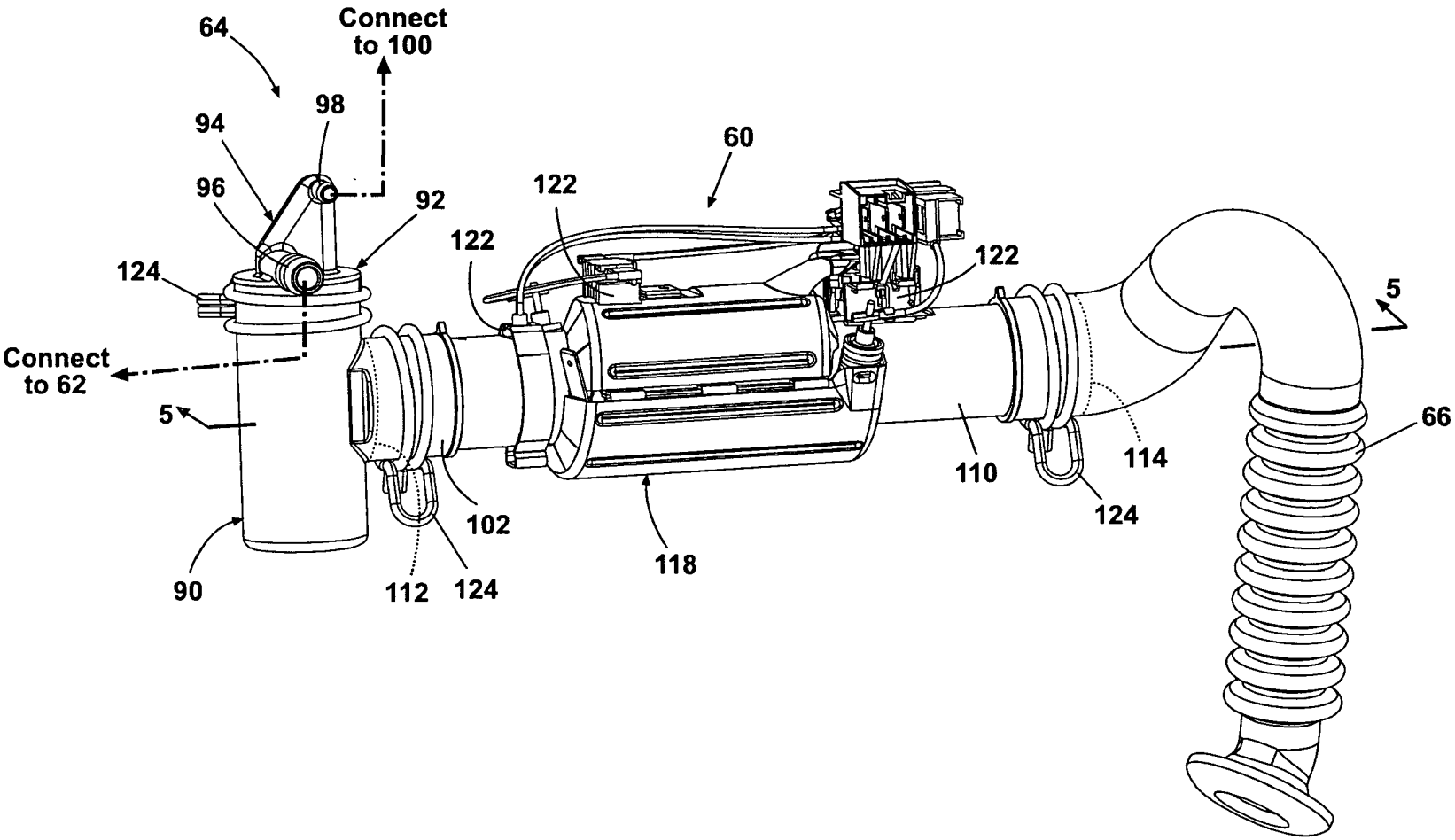
FIG. 4 is a perspective view of a steam generator from the fabric treatment appliance of FIG. 1.
Figure 5:
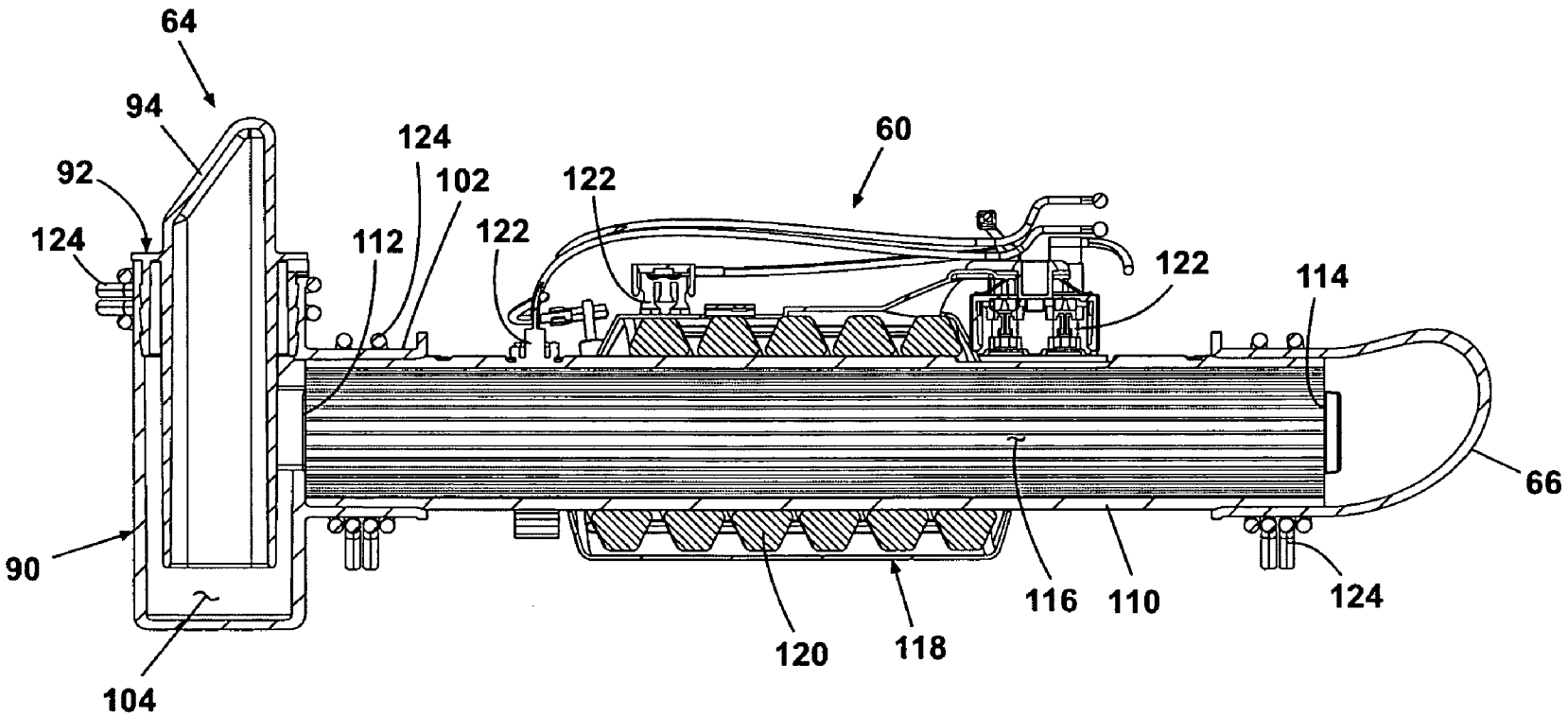
FIG. 5 is a sectional view taken along line 5-5 of FIG. 4.

FIG. 4 provides a perspective view of the reservoir 64, the steam generator 60, and the steam conduit 66. In general, the reservoir 64 may be configured to receive water from the water supply 29, store a volume of water, and supply water to the steam generator 60. In the exemplary embodiment, the reservoir 64 may include an open-top tank 90 and a lid 92 removably closing the open top of the tank 90. The reservoir 64 may include a water supply conduit 94 for supplying water from the water supply 29 to the tank 90. In the illustrated embodiment, the water supply conduit 94 may extend through the lid 92 and include a water supply inlet connector 96 and a siphon break connector 98. The water supply inlet connector 96 may be coupled to the second water supply conduit 62 (FIG. 2) to receive water from the water supply 29 and provide the water to the water supply conduit 94. The siphon break connector 98 may be coupled to a siphon break conduit 100 (FIG. 2) to form a siphon break device. The siphon break conduit 100 may be coupled to atmosphere external to the washing machine 10. The water supply inlet connector 96, the siphon break connector 98, and the water supply conduit 94 may be in fluid communication with one another. The reservoir 64 may further include a steam generator connector 102 for coupling the tank 90 to the steam generator 60 and supplying water from the tank 90 to the steam generator 60. In the illustrated embodiment, the steam generator connector 102 may project laterally from the tank 90. As seen in FIG. 5, which is a sectional view of the reservoir 64, the steam generator 60, and the steam conduit 66, the steam generator connector 102 fluidly communicates the steam generator 60 with an interior or chamber 104 of the tank 90.

With continued reference to FIG. 5, while the steam generator 60 can be any type of steam generator, the exemplary steam generator 60 of the current embodiment is in the form of an in-line steam generator with a tube 110 having a first end 112 coupled to the steam generator connector 102 of the reservoir 64 and a second end 114 coupled to the steam conduit 66. The tube 110 may define a steam generation chamber 116 between the first end 112 and the second end 114, which may defined an inlet and an outlet, respectively, of the steam generator 60. A heat source 118 may be positioned relative to the tube 110 and the steam generation chamber 116 to provide heat to the tube 110 and the steam generation chamber 116. In the current embodiment, the heat source 118 includes a resistive heater 120 coiled around the tube 110 in a generally central location relative to the first and second ends 112, 114. The steam generator 60 may have temperature sensors 122 associated with the tube 110 and/or the heat source 118 and in communication with the controller 70 for operation of the heat source 118 and/or supply of water to the steam generator 60. Clamps 124 may be employed to secure the steam generator tube 110 to the steam generator connector 102 of the reservoir 64 and to the steam conduit 66 and to secure the reservoir lid 92 to the tank 90.

The steam generator 60 may be employed for steam generation during operation of the washing machine 10, such as during a wash operation cycle, which can include prewash, wash, rinse, and spin steps, during a washing machine cleaning operation cycle to remove or reduce biofilm and other undesirable substances, like microbial bacteria and fungi, from the washing machine, during a refresh or dewrinkle operation cycle, or during any other type of operation cycle. The steam generator may also be employed for generating heated water during operation of the washing machine 10. The steam generator 60 may also be employed to clean itself, and an example of a method for cleaning the steam generator 60 is disclosed in the U.S. patent application titled "Method for Cleaning a Steam Generator," having reference number 71354-0576/US20070340, which is incorporated herein by reference in its entirety.

As the degree of calcification of the steam generator 60 increases, the steam generator 60 or associated hoses, such as the steam conduit 66 (FIG. 2) may become blocked, which may lead to decreased performance of the steam generator 60. Further, other problems related directly or indirectly to the steam generator 60 and discussed in the background of the invention may occur during operation of the washing machine 1O. Some of the problems, such as a closed or blocked water tap or water supply 29, blockage of the steam conduit 66 between the steam generator 60 and the tub 14, and blockage of the steam generator 60, may be detected based on the actual temperature of the steam generator 60, and other problems, such as leaks on the second supply conduit 62 and low steam efficiency due to undervoltage or severe calcification, may be detected based on the temperature of the tub 14. These problems will be collectively referred to hereinafter as abnormalities, and the abnormalities may include other abnormalities not specifically listed herein. In the exemplary embodiments, the abnormalities may be detected based on temperature variation of the steam generator 60 and the tub 14, respectively. While several factors may influence the temperature variation of the steam generator 60 and the tub 14, behavior of the temperature variation resulting from various abnormalities may be empirically observed and employed for detection of the abnormalities.

For detection of at least one of the abnormalities based on the temperature variation of the steam generator 60, the controller 70 monitors the actual temperature of the steam generator 60, which may be determined by the temperature sensors 122 or other temperature detection devices, and determines the rate of change of the actual temperature (i.e., the slope of the actual temperature as a function of time, also referred to as a temperature gradient). Based on the rate of change of the actual temperature, the controller 70 may determine whether an abnormality has occurred. For example, the controller 70 may compare the rate of change of the actual temperature to one or more predetermined limits or values and, based on the comparison, determine whether an abnormality has occurred. Identification of an abnormality may be made, for example, if the rate of change exceeds the predetermined limit and/or if the rate of change exceeds the predetermined limit for a predetermined period of time. The predetermined limits may be empirically determined and may be dependent on the operational phase of the steam generator. For example, the predetermined limit may be employed during the entire operation of the steam generator 60 or during only one or more phases of the steam generator 60, such as during the steam generation phase but not the initial phase as the actual temperature typically rapidly increases during the initial phase. The controller 70 may detect the operational phase based on the actual temperature of the steam generator 60 for determining the predetermined limits to be employed. For example, when the actual temperature is below a predetermined temperature, the controller 70 may conclude that the current operational phase is the initial phase. The controller 70 may perform any desirable action in response to detection of an abnormality, and the action may depend on the type of abnormality detected. For example, the controller 70 may shut off power to the steam generator 70 and/or may communicate to the user that an abnormality has occurred, such as via the control panel 80.

Figure 6:
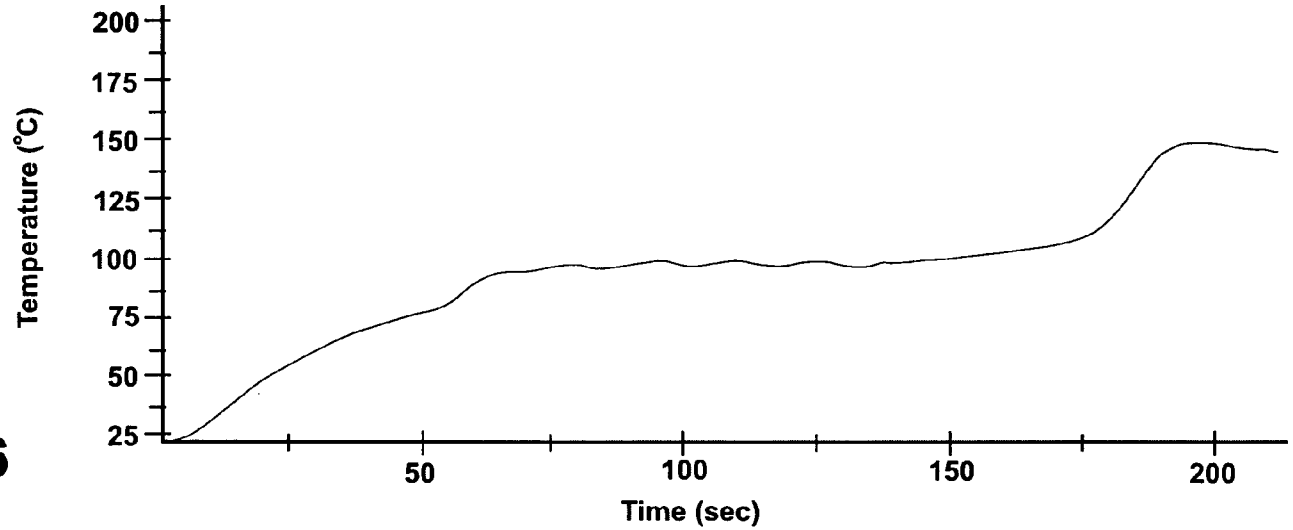
FIG. 6 is an exemplary graph of steam generator temperature as a function of time during operation of the steam generator from the washing machine of FIG. 1.
Figure 7:
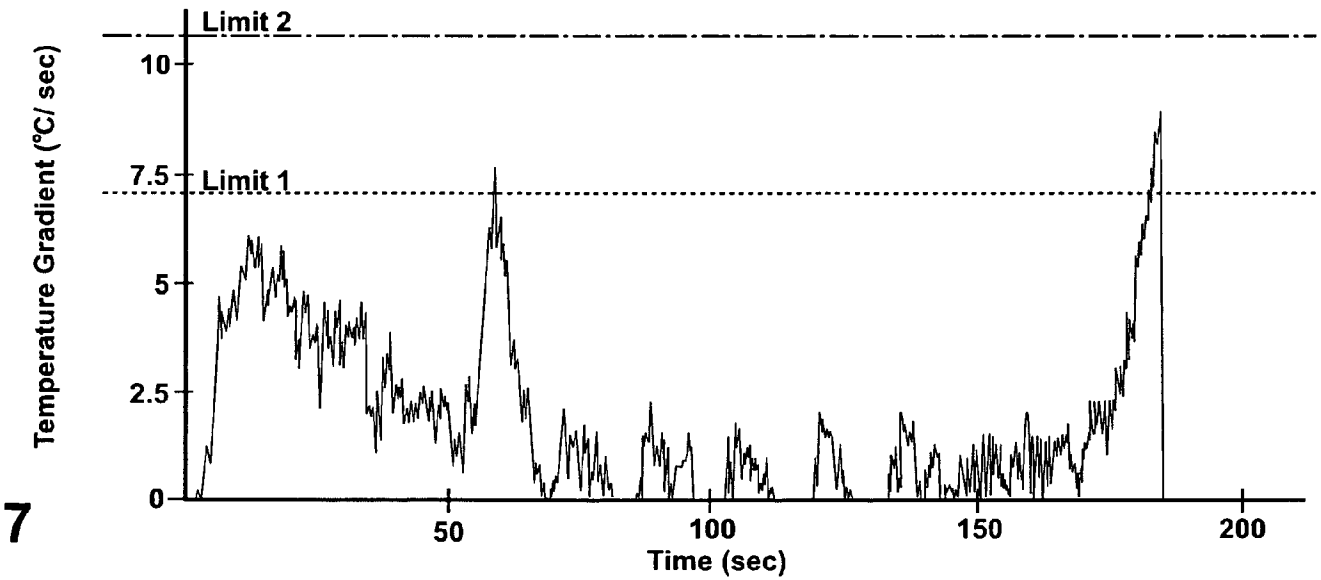
FIG. 7 is an exemplary graph of steam generator temperature gradient as a function of time for the operation of the steam generator shown in the graph of FIG. 6.

Referring now to FIG. 6, which is an exemplary graph of the actual temperature of the steam generator 60 as a function of time during operation of the steam generator 60, the actual temperature increases during the initial phase of operation (e.g., from about 0 to 70 seconds) and then remains relatively constant during the steam generation phase of operation or steady state steam generation phase (e.g., after about 70 seconds) until an abnormality occurs around 185 seconds. Referring now to FIG. 7, which is an exemplary graph of the rate of change of the actual temperature as a function of time for the operation of the steam generator 60, the illustrated example employs two predetermined limits, a limit 1 and a limit 2 greater than the limit 1. In the current example, the limit 1, which is about 7° C./second, is employed only after the initial phase, while the limit 2, which is about 10.5° C./second, is utilized during the entire operation of the steam generator 60. The rate of change of the actual temperature exceeds the limit 1 at around 60 seconds during the initial phase; however, because the limit 1 is not employed during the initial phase, the controller 70 does not detect an abnormality. At around 180 seconds during the steam generation phase, the rate of change of the actual temperature exceeds the limit 1, and the controller 70 detects an abnormality, thereby shutting off power to the steam generator 60. In the given example, the rate of change of the actual temperature does not reach the limit 2.

For detection of at least one of the abnormalities based on the temperature variation of the receptacle or tub 14, the controller 70 monitors the temperature of the tub 14, which may be determined by at least one of the temperature sensors 54, 56 or other temperature detection devices, and determines the rate of change of the temperature (i.e., the slope of the temperature as a function of time, also referred to as a temperature gradient). Based on the rate of change of the temperature, the controller 70 may determine whether an abnormality has occurred. For example, the controller 70 may compare the rate of change of the temperature to a predetermined limit or value and, based on the comparison, determine whether an abnormality has occurred. Identification of an abnormality may be made, for example, if the rate of change does not reach or exceed the predetermined limit within a predetermined period of time, thereby indicating that an abnormality prevents steam from the steam generator 60 from heating the tub 14, the interior of the tub 14, and/or wash water in the tub 14. The predetermined limit and predetermined period of time may be empirically determined. The controller 70 may perform any desirable action in response to detection of an abnormality, and the action may depend on the type of abnormality detected. For example, the controller 70 may shut off power to the steam generator 70 and/or may communicate to the user that an abnormality has occurred, such as via the control panel 80.

The methods described above for detection of abnormalities of the washing machine 10 and/or the steam generator 60 may be employed individually or together in various combinations. Further, the methods may be utilized in various types of fabric treatment appliances having various types of steam generators and are not limited for use with the washing machine 10 and the steam generator 60 described above and shown in the figures.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method of controlling the operation of a steam generator in a fabric treatment appliance, the method comprising:

operating the steam generator in an initial phase where the steam generator is brought up to a temperature sufficient to generate steam;

after the initial phase, operating the steam generator in a steam generation phase where steam is generated;

comparing a rate of temperature change of the steam generator to a first predetermined value prior to and during the steam generation phase of the steam generator;

comparing the rate of temperature change of the steam generator to a second predetermined value lower than the first predetermined value only during the steam generation phase of the steam generator; and controlling the operation of the steam generator based on at least one of the comparisons.

2. The method according to claim 1 wherein the controlling the operation of the steam generator comprises turning the steam generator off.

3. The method according to claim 1 wherein the comparing of the rate of temperature change to one of the first and second predetermined values comprises determining whether the rate of temperature change is greater than or equal to the one of the first and second predetermined values for a predetermined period of time.

4. The method according to claim 1, further comprising determining that an abnormality has occurred based on at least one of the comparisons.

5. The method according to claim 4, further comprising indicating to a user that the abnormality has occurred.

* * * * *